US006838648B2

(12) United States Patent
Watanabe et al.

(10) Patent No.: US 6,838,648 B2
(45) Date of Patent: Jan. 4, 2005

(54) TEMPERATURE DETECTION UNIT IN A HIGH-FREQUENCY HEATING AND COOKING APPARATUS

(75) Inventors: Kenji Watanabe, Nara (JP); Isao Kasai, Nabari (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/402,421

(22) Filed: Mar. 28, 2003

(65) Prior Publication Data

US 2003/0183624 A1 Oct. 2, 2003

(30) Foreign Application Priority Data

Apr. 1, 2002 (JP) ..... P. 2002-098380

(51) Int. Cl.[7] ..... H05B 6/68; H05B 6/72

(52) U.S. Cl. ..... 219/711; 219/748; 219/756; 374/149

(58) Field of Search ..... 219/711, 710, 219/746, 747, 748, 749, 756, 732; 374/149

(56) References Cited

U.S. PATENT DOCUMENTS 4,421,968 A * 12/1983 Osepchuk ..... 219/749

FOREIGN PATENT DOCUMENTS

| | | |
|---|---|---|
| JP | 59-171492 | 9/1984 |
| JP | 11-190523 | 7/1999 |
| JP | 2001-250672 | 9/2001 |
| JP | 2001-304564 | * 10/2001 |
| JP | 2001-324147 | 11/2001 |
| JP | 2001-345171 | * 12/2001 |
| JP | 2002-5450 | * 1/2002 |
| JP | 2002-89848 | 3/2002 |
| JP | 2002-93569 | 3/2002 |

* cited by examiner

*Primary Examiner*—Philip H. Leung
(74) *Attorney, Agent, or Firm*—Pearne & Gordon LLP

(57) ABSTRACT

This invention provides a heating and cooking apparatus in which foods can be accommodated in a heating chamber with good maneuverability and an appropriate finish can be obtained. A temperature detector detects infrared radiation through an opening provided on a wall surface opposed to an opening part for taking in and out foods of a heating chamber. The temperature detector detects the temperature of a plurality of parts on a sealing having the substantially same electric wave penetrability as that of the bottom surface of the heating chamber. Accordingly, even when two foods are arranged right and left irrespective of the size of the foods, the temperature of both the foods can be detected. Then, the user does not needs to extend a hand to the interior of the heating chamber and arrange the foods in front and back positions.

8 Claims, 5 Drawing Sheets

TEMPERATURE DETECTION UNIT IN A HIGH-FREQUENCY HEATING AND COOKING APPARATUS

BACKGROUND OF THE INVENTION

1. Field of the Invention

The present invention relates to a high frequency heating apparatus for heating a material to be heated such as food in which the temperature of the material to be heated is detected to efficiently heat the material to be heated, make a heating distribution uniform and automate a cooking.

2. Description of the Related Art

As such a heating and cooking apparatus, a cooking and heating apparatus has been hitherto disclosed in, for is example, JP-A-2001-250672. FIG. 7 shows the conventional heating and cooking apparatus described in the above-described publication.

In FIG. 7, in a microwave range, a bottom plate 1 forms a bottom surface of a heating chamber 2. Microwave oscillated by a magnetron 3 is supplied to a wide area in the heating chamber 2 by a rotary antenna 4. In the microwave range, a method for heating the food in the heating chamber 2 is different depending on a rotating position where the rotary antenna 4 is stopped or a position where the food is mounted on the bottom plate 1. In the right side surface of the heating chamber 2, a hole 5 is formed. One end of a detection path 6 is connected to the hole 5 of the heating chamber 2. Then, to the other end of the detection path 6, an infrared sensor 7 is attached. The infrared ray sensor 7 has a visual field in the heating chamber 2 and can detect an amount of infrared ray radiated in the visual field. That is, the infrared ray sensor can detect temperature in the visual field. Then, when the magnetron 3 oscillates microwave, the rotary antenna 4 is rotated to and stopped at a rotating position where the food is most efficiently heated at a determined position where the food is mounted.

In the conventional structure, as shown in FIG. 8, the hole 5 is formed in the right side surface of the heating chamber 2 and the infrared ray sensor 7 detects the temperature in the visual field through the detection path 6. When two foods 8 and 9 of different size are heated, if the larger food 8 is placed near the infrared ray sensor 7, infrared rays radiated by the smaller food 9 are interrupted by the food 8. Thus, the infrared rays may not possibly reach the infrared ray sensor 7 so that the temperature of the food 9 cannot be detected to overheat the staller food. Accordingly, when such foods having different size are heated, unless the smaller food is placed in the right side or the two foods are placed in the direction of length of the heating chamber 2, the temperature of the two foods cannot be detected. Therefore, a user needs to consider positions where the foods are to be placed depending on the size of the foods or a user needs to extend a hand to an interior of the heating chamber 2 and place the foods. Accordingly, maneuverability is not inconveniently good.

SUMMARY OF THE INVENTION

In order to solve the above-described conventional problems, the present invention provides a heating and cooking apparatus, which is good in maneuverability and capable of detecting the temperature of food and automatically cooking.

In order to solve the above-described conventional problems, a heating and cooking apparatus according to the present invention , includes a heating chamber for accommodating food; a heating unit for heating the food in the heating chamber; a sealing unit having the substantially same electric wave penetrability as that of the bottom surface of the heating chamber; and a temperature detector for detecting the temperature of a plurality of parts on the sealing unit by detecting infrared rays through an opening provided on a wall surface opposed to an opening part for taking in and out the food of the heating chamber.

Thus, even when a user arranges two foods right and left irrespective of the size of the foods from the opening part for taking in and out the food of the heating chamber, the user can detect the temperature of both the foods. Thus, the user does not need to extend a hand to the interior of the heating chamber and arrange the foods in front and back positions and maneuverability is improved.

In accordance with one aspect, the present invention includes a heating chamber for accommodating food; a heating unit for heating the food in the heating chamber; a sealing unit having the substantially same electric wave penetrability as that of the bottom surface of the heating chamber; and a temperature detector for detecting the temperature of a plurality of parts on the sealing unit by detecting infrared rays through an opening provided on a wall surface opposed to an opening part for taking in and out the food of the heating chamber. Thus, even when a user arranges two foods right and left irrespective of the size of the foods from the opening part for taking in and out the food of the heating chamber, the user can detect the temperature of both the foods. Thus, the user does not need to extend a hand to the interior of the heating chamber and arrange the foods in front and back positions and maneuverability is improved.

In accordance with another aspect, the present invention provides a heating chamber whose bottom surface is especially rectangular and whose breadth or width is longer than length. Thus, a plurality of foods can be arranged in the direction of width of the heating chamber, the dimension of length of the heating chamber can be reduced and the dimension of length of the heating and cooking apparatus can be reduced. Accordingly, the heating and cooking apparatus can be disposed on a stand having small length.

In accordance with yet another aspect, the present invention provides an agitator made of metal for agitating electric waves in the heating chamber below the sealing unit. Accordingly, the electric waves near the food can be more agitated to realize a uniform heating.

In accordance with yet another aspect of the present invention, because the electric waves are supplied from the lower part of the agitator in the heating and cooking apparatus, the electric waves can be efficiently absorbed to the food and more agitated to realize a uniform In accordance with yet another aspect, the present invention provides that the agitator in the heating and cooking apparatus rotates on its axis and has a directivity that the electric waves are radiated to a specific direction. Thus, such a particular control as to strongly heat food located in the specific direction can be achieved.

In accordance with yet another aspect, the present invention provides that the agitator of the heating and cooking apparatus has a function for detecting a turning angle. Thus, the agitator can be controlled toward a specific direction with good accuracy.

In accordance with yet another aspect the present invention provides that the agitator in the heating and cooking apparatus detects the turning angle by using a Hall Element.

Thus, the turning angle can be detected under a non-contact state with good accuracy and excellent durability due to no abrasion.

In accordance with yet another aspect the present invention provides that the temperature detector of the heating and cooking apparatus, infrared ray detecting elements which are linearly arranged are scanned by a driving mechanism. Thus, the temperature of a plurality of parts of all the bottom surface of the heating chamber can be detected.

In accordance with yet another aspect the present invention provides that the heating and cooking apparatus, the infrared ray detecting elements arrange linearly are mounted on a board and the board has the length perpendicular to the linearly arranged direction of the infrared ray detecting elements shorter than the length of the linearly arranged direction of the infrared ray detecting elements. Thus, a space necessary for moving is reduced so that the temperature of a plurality of parts on all the bottom surf ace of the heating chamber can be detected with a small space and the external form of the cooking and heating apparatus can be made small.

In accordance with yet another aspect the present invention provides that the heating unit or the agitator in the heating and cooking apparatus can be controlled in accordance with the detected results of the temperature detector. A part of the food whose temperature is low is detected to control the agitator and especially strongly heat the part of the food whose temperature is low. Thus, a uniform heating can be realized.

In accordance with yet another aspect the present invention provides that the temperature detector is provided in an upper part of a substantially central part in horizontal direction of an inner wall surface of the heating chamber, and the inner wall surface is opposed to the opening part. Because of the position of the temperature detector, it is possible to detect temperatures of the foods all over when the foods are arranged not in a depth direction but in a horizontal row of the heating chamber.

Figure 1:
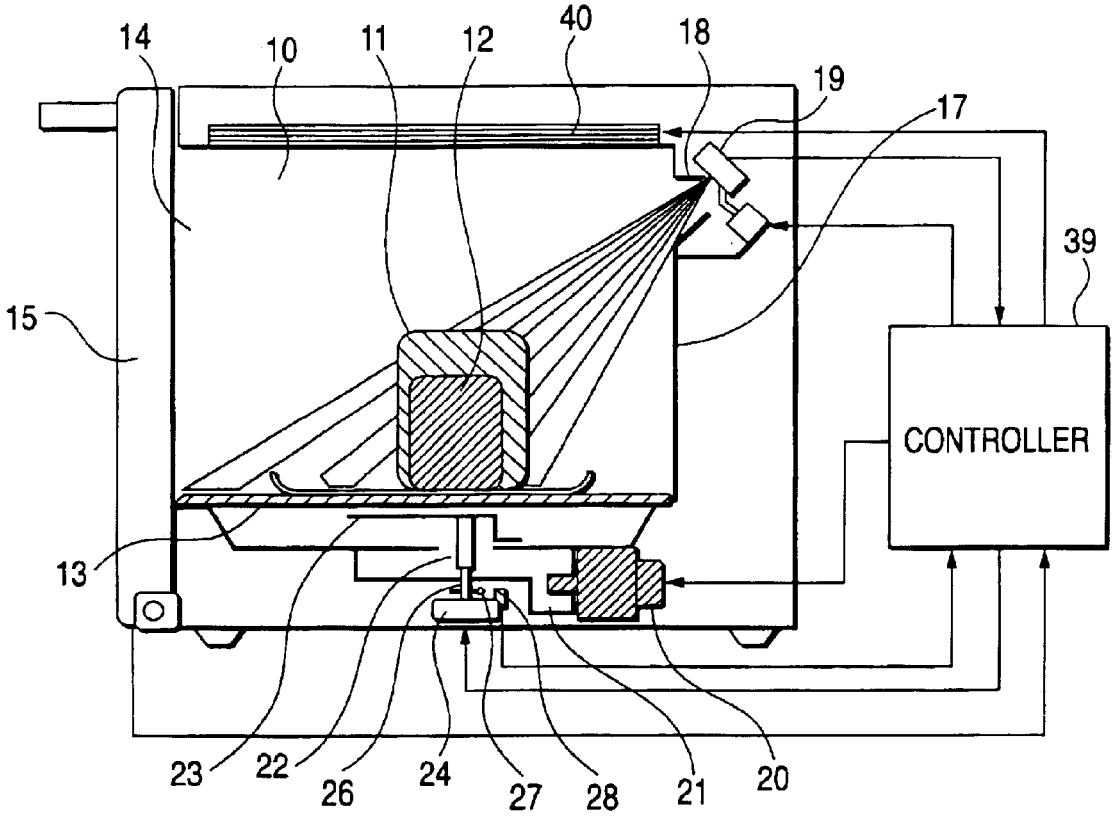
FIG. 1 is a sectional view of a heating and cooking apparatus according to a first embodiment of the present invention.

In the drawings, the reference numeral 10 refers to a heating chamber; 13 to sealing means; 18 to an opening of temperature detector; 19 to a temperature detector; 20 to a magnetron; and 39 to a controller.

DETAILED DESCRIPTION OF THE PREFERRED EMBODIMENTS

Now, an embodiment of the present invention will be described by referring to the drawings.

(First Embodiment)

FIG. 1 is a sectional view of a heating and cooking apparatus according to a first embodiment of the present invention.

In FIG. 1, reference numeral 10 designates a heating chamber for accommodating foods 11 and 12. The foods 11 and 12 are mounted on a sealing means 13 substantially the same as the bottom surface of the heating chamber 10. For the sealing means 13, a material having electric wave penetrability such as glass, ceramics or a resin is used. In an opening part 14 for taking in and out the foods of the heating chamber 10, a freely opened and closed door 15 is provided.

Figure 2:
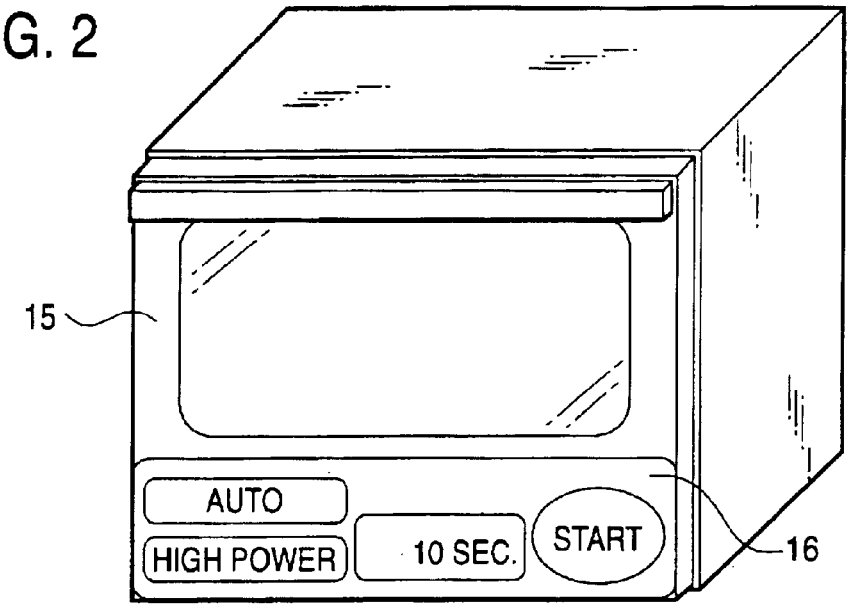
FIG. 2 is a perspective view of the heating and cooking apparatus according to the first embodiment of the present invention.

In a perspective view of the heating and cooking apparatus of the present invention shown in FIG. 2, an operating part 16 is provided in the lower part of the door 15 to instruct a selection of menu and a start of heating or the like. On a side surface 17 opposed to the opening part 14 of the heating chamber 10, an opening 18 is provided. A temperature detector 19 is provided near the outside of the opening 18. In the lower part of the heating chamber 10, a magnetron 20 for oscillating electric waves is provided. The oscillated electric waves are fed to the heating chamber 10 from a feeding port 22 provided at a substantially central part of a lower part of the heating chamber 10 through a wave guide 21. Thus, the electric waves are efficiently absorbed to the foods placed just above the feeding port 22 to improve a heating efficiency. In the upper part of the feeding port 22, a rotary wave-guide 23 is provided and driven to rotate by a driving motor 24. Thus, electric waves near the foods can be more agitated to realize a uniform heating.

Figure 3:
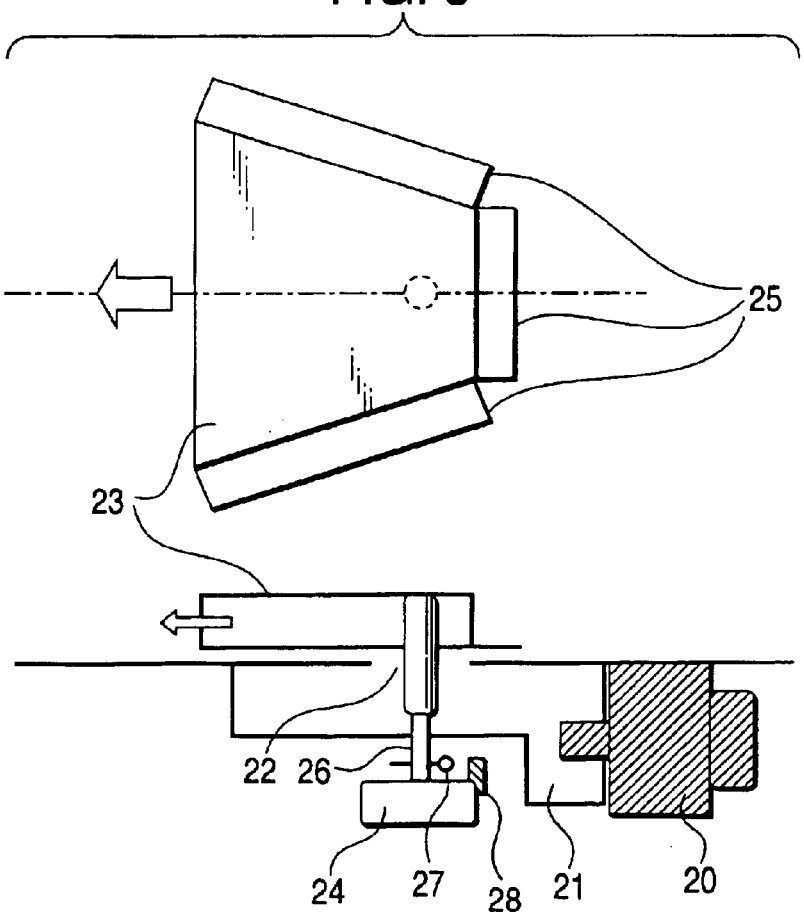
FIG. 3 is a top view and a main part enlarged view of an agitator of the heating and cooking apparatus according to the first embodiment of the present invention.

In a main part enlarged view shown in FIG. 3, the rotary wave-guide 23 has flanges 25 in three directions and one of them is opened. The electric waves have a high directivity toward the opened direction as shown by an arrow mark. Accordingly, such a control as to especially strongly heat the food located in a specific direction can be achieved. In this embodiment, the rotary wave-guide 23 and the driving motor 24 form an agitator. On the rotating shaft 26 of the driving motor 24, a magnet 27 is provided. A Hall element 28 is provided near the rotating shaft 26 to detect the turning angle of the rotary wave-guide 23

Figure 4:
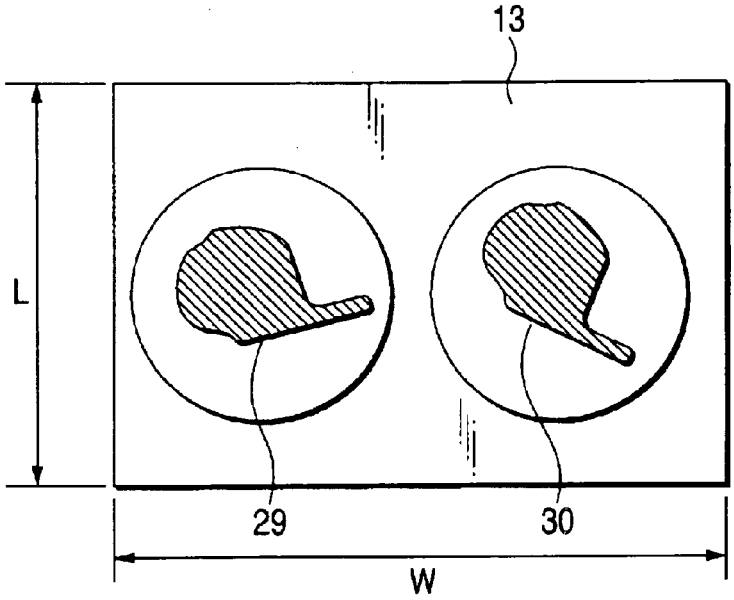
FIG. 4 is a top view of a bottom surface of a heating chamber of the heating and cooking apparatus according to the first embodiment of the present invention.

In a view showing the bottom surface of the heating chamber 10 illustrated in FIG. 4, the bottom surface of the heating chamber 10 is formed in a rectangular shape and the sealing means 13 is also formed in a rectangular shape with the substantially same configuration. A width W is larger than a length L. Accordingly, a plurality of foods 29 and 30 are arranged traverse as shown in the drawing. Since a dish having the outside diameter of 20 cm is most frequently used, the width desirably has 40 cm or more so that the two dishes having the above-described dimension are arranged. The length desirably has 30 cm or more so that one large dish of 30 cm can be accommodated. Accordingly, the dimension of length of the heating chamber can be decreased and the dimension of length of the heating and cooking apparatus can be decreased irrespective of a fact that more foods can be accommodated. Thus, the heating and cooking apparatus can be disposed on a stand having a small length.

Figure 5:
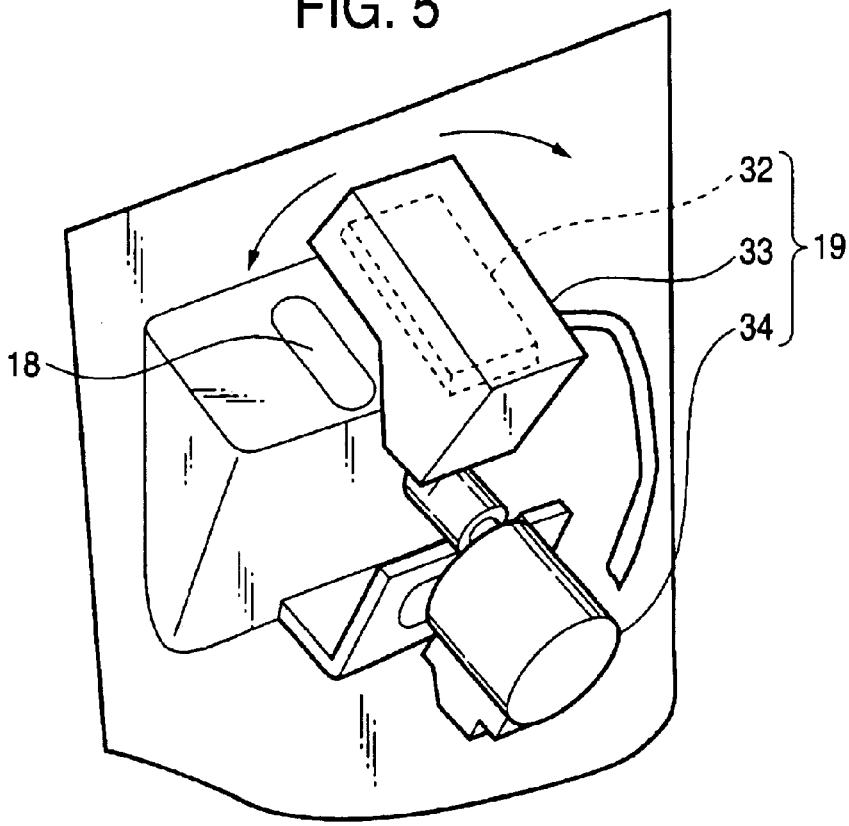
FIG. 5 is a main part enlarged view of a part near a temperature detector according to the first embodiment of the present invention.

In a main part enlarged view showing a part near the temperature detector 19 illustrated in FIG. 5, the opening 18 is provided on the side wall 31 of the heating chamber 10. The opening 18 is provided in the upper part of a substantially central part from side to side on the side wall 31 and the temperature detector 19 is provided in the vicinity thereof. The temperature detector 19 comprises a case 33 for accommodating an infrared ray sensor 32 and a motor 34 for scanning and driving the case 33. The case 33 is made of an electric conductive plastic mixed with metal or carbon fibers for shielding the infrared ray sensor 32 from the electric waves. The case 33 is scanned by the motor 34 in the directions of arrow marks shown in FIG. 5.

Thus, even when a user arranges two foods right and left irrespective of the size of the foods from the opening part for taking in and out the foods of the heating chamber, the user can detect the temperature of both the foods. The user does not need to extend a hand to the interior of the heating chamber 10 and arrange the foods in front and back positions and maneuverability is improved. Further, Since the temperature detector 19 is provided at the central part in the traverse direction on the side wall 31, the foods arranged right and left can be caught at the substantially same angle of visibility. Accordingly, the temperature difference of the foods arranged right and left can be accurately detected.

Figure 6:
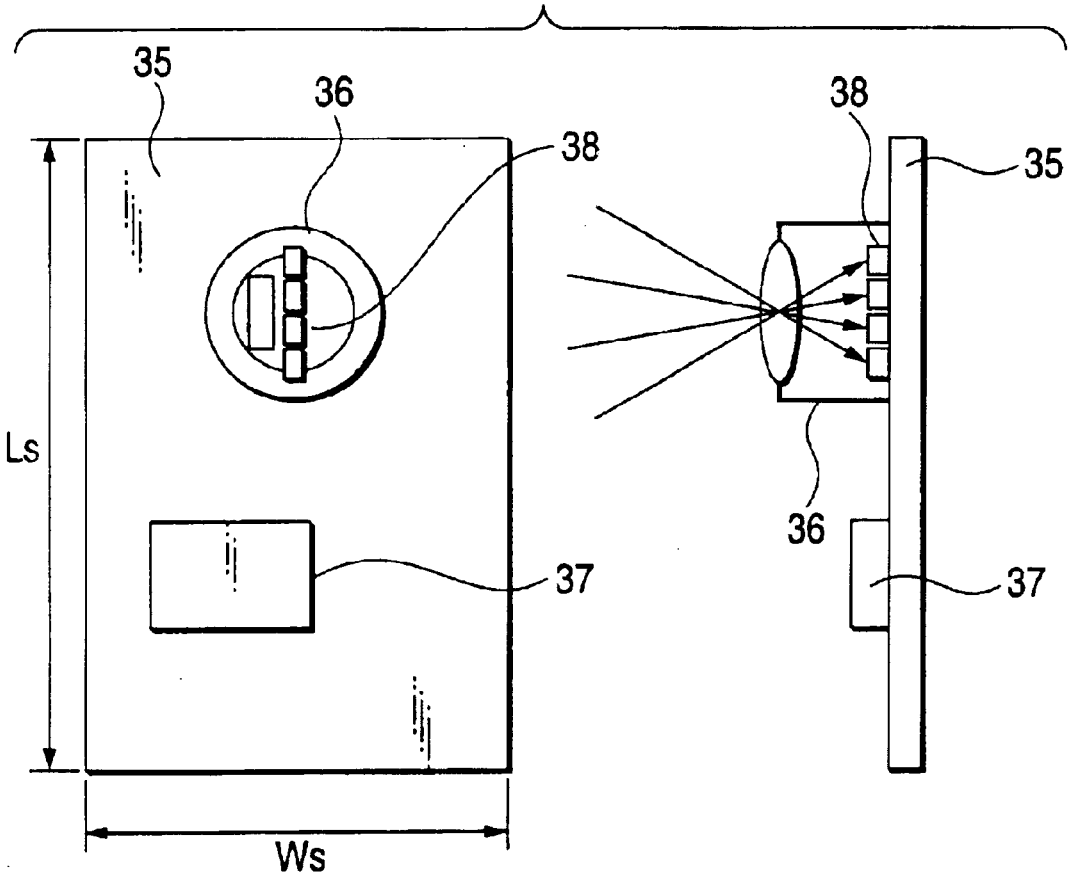
FIG. 6 is an enlarged view of an infrared ray sensor according to the first embodiment of the present invention.
Figure 7:
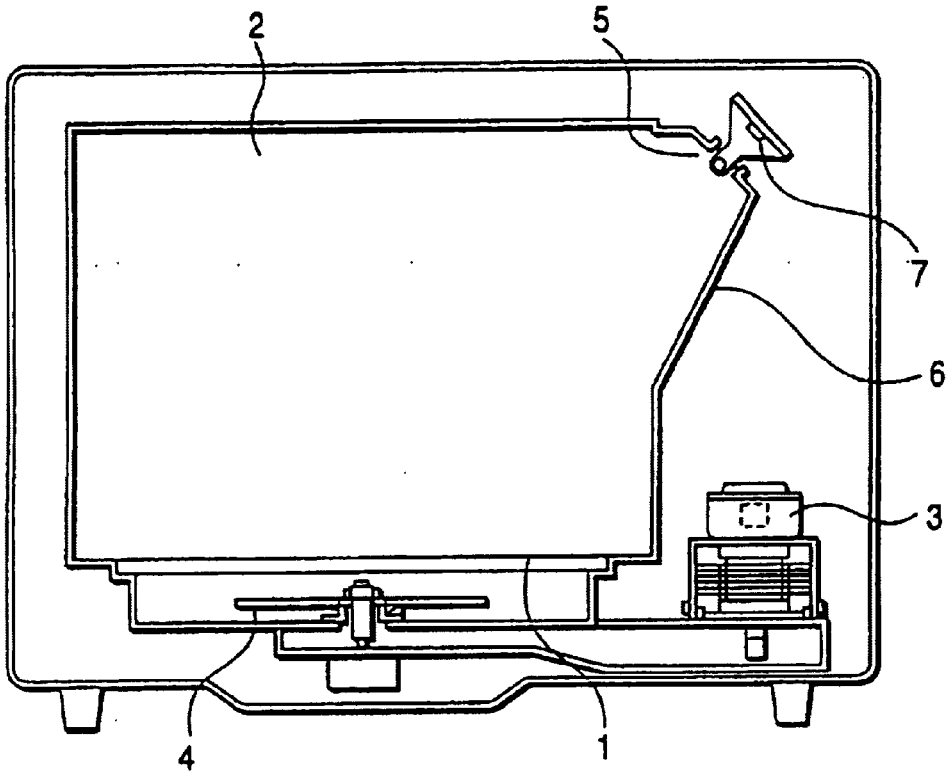
FIG. 7 Prior Art
FIG. 7 is a sectional view of a conventional is heating and cooking apparatus.
Figure 8:
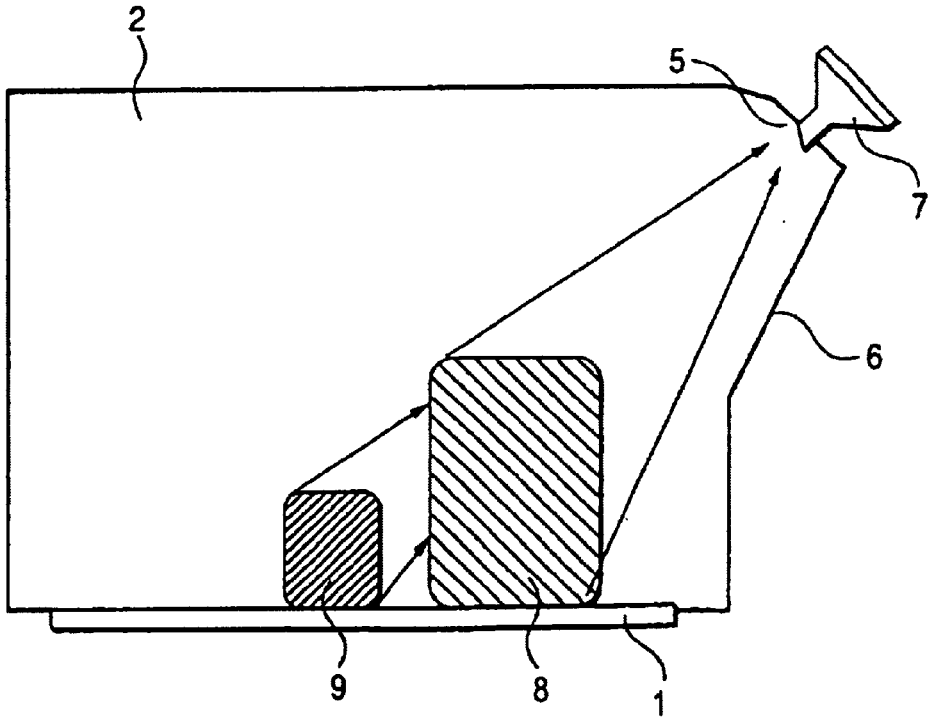
FIG. 8 Prior Art
FIG. 8 is a sectional view of a heating chamber of the conventional heating and cooking apparatus.

In an enlarged view of the infrared ray sensor 32 shown in FIG. 6, an infrared ray sensor element 36 and an IC 37 for an amplifying circuit or the like are mounted on a circuit board 35. In the infrared ray sensor element 36, a plurality of infrared ray detecting elements 38 made of thermo-piles are contained. Although four elements are described in this embodiment, the present invention is not limited thereto. The infrared ray detecting elements 38 are longitudinally arranged in a linear direction. At this time, the dimension Ws of the circuit board 35 is smaller than dimension Ls. Thus, the width of the case 33 can be reduced and a range to be scanned can be widened. Even when the width of the sealing means 13 is large, the temperature of an entire part can be detected. Further, a space necessary for moving is decreased so that the temperature of a plurality of parts of all the bottom surface of the heating chamber can be detected with a small space and the external form of the heating and cooking apparatus can be made compact.

Further, on the upper surface of the heating chamber 10, a motor 40 is provided so as to scorch the foods. The length of the heating chamber 10 is smaller than the width. Therefore, it is to be understood that, in order to completely detect a large number of parts on all the bottom surface of the heating chamber 10 as many as possible, the number of parts to be measured in the direction of width needs be increased tore than the number of parts to be measured in the direction of length.

In such a structure of the heating chamber 10, the temperature detector 19 is provided on the wall surface opposed to the opening part for taking in and out the foods of the heating chamber 10, so that the number of the infrared ray detecting elements 38 can be reduced. Accordingly, the structure of the temperature detector 19 can be simplified and a yield and reliability are improved. As for the direction of width of the heating chamber 10, only the driving angle of the motor 34 is controlled to increase or decrease the number of parts to be measured in accordance with the dimension of width.

An operation and effects of the heating and cooking, apparatus constructed as mentioned above will be described below.

Firstly, the foods 11 and 12 are accommodated in the heating chamber 10 and mounted on the sealing means 13. In the operating part of the door 15, a menu is selected and finish temperature is adjusted to instruct a start of heating. The instruction for starting a heating operation is transmitted to a controller and the magnetron 20 oscillates electric waves to feed the electric waves to the heating chamber 10 from the feeding port 22 through the wave guide 21 on the upper part of the feeding port 22, the rotary wave-guide 23 as the agitator is driven to rotate by the driving motor 24. The magnet 27 is provided on the shaft 26 of the driving motor 24 and rotates in synchronization with the rotary wave-guide 23. In the vicinity of the rotating shaft 26, the Hall element 28 for detecting the pass of the magnet 27 is provided. Time after the magnet 27 passes the Hall element 28 is measured so that the rotating position of the rotary wave-guide 23 can be detected.

Thus, a non-contact detection can be realized with good accuracy, no abrasion and excellent durability. The electric waves agitated by the rotary wave-guide 23 are absorbed by the foods 11 and 12 to heat them. On the side surface 17, the opening 18 is provided and the temperature detector 19 is provided near the outside of the opening 18. The infrared ray sensor on which the infrared ray sensor elements arranged linearly are mounted is scanned right and left by the motor 34. During heating, the temperature of substantially all the areas on the sealing means 13 can be detected and the temperature of the foods 11 and 12 on the sealing means 13 during heating is also detected. The temperature is detected from the opening 18 provided on the side wall surface 17, so that even when liquid put in a cup suddenly boils, the liquid is hardly scattered on the temperature detector 19 and the performance of the temperature detector 19 is hardly deteriorated.

The temperature detector 19 detects that the temperature difference between the foods 11 and 12 is large during heating. At this time, the rotary wave-guide 23 is stopped at a position to which the rotary wave-guide 23 high in its directivity is directed to radiate the electric waves to a direction where the food at low temperature is located. Thus, the food whose temperature is low is especially strongly heated to eliminate the temperature difference between the respective foods. When the temperature difference is decreased, the rotary wave-guide 23 is driven again to rotate. Thus, even when a plurality of foods having different quantity or a plurality of foods such as frozen foods and foods at ordinary temperature are heated at the same time, they can be finished at the same temperature.

As described above, according to the present invention defined in claims 1 to 10, a user arranges a plurality of foods right and left irrespective of size of the foods from the opening part for taking in and out the foods of the heating chamber. Even in this case, the user can detect the temperature of both the foods with good maneuverability. Further, the temperature of any food can be accurately detected. Since the rotary wave-guide is controlled in accordance with the detected result, any food can be heated to a good finish.

What is claimed is:

1. A heating and cooking apparatus comprising:

a heating chamber for accommodating food;

a heating unit for heating the food of the heating chamber by electric wave;

a sealing unit having the substantially same electric wave penetrability as that of the bottom surface of the heating chamber;

an opening part for taking in and out the food of the heating chamber; and a temperature detector provided on a wall surface opposed to the opening part;

wherein an infrared radiation is detected through an opening of the temperature detector so as to detect a temperature of the food, wherein the bottom surface of the heating chamber has a rectangular form and the breadth of the heating chamber is longer than length and wherein the opening part is positioned along the breadth;

wherein the temperature detector is designed to scan infrared ray detecting elements arranged linearly by a driving mechanism; and wherein the infrared ray detecting elements arranged linearly are mounted on a board and the board has a length perpendicular to the linearly arranged direction shorter than the length of the linearly arranged direction of the infrared ray detecting elements.

2. The heating and cooking apparatus according to claim 1, wherein an agitator made of metal for agitating the electric wave in the heating chamber is provided in the lower part of the sealing unit.

3. The heating and cooking apparatus according to claim 2, wherein the electric wave is supplied from the lower part of the agitator.

4. The heating and cooking apparatus according to claim 2, wherein the agitator rotates on its axis and has a directivity that the electric wave is radiated to a specific direction.

5. The heating and cooking apparatus according to claim 2, wherein the agitator has a function for detecting a turning angle.

6. The heating and cooking apparatus according to claim 5, wherein the turning angle of the agitator is detected by using a Hall element.

7. The heating and cooking apparatus according to claim 1, wherein the heating unit or the agitator is controlled in accordance with the detected results of the temperature detector.

8. A heating and cooking apparatus comprising:

a heating chamber for accommodating food;

a heating unit for heating the food of the heating chamber by electric wave;

a sealing unit having the substantially same electric wave penetrability as that of the bottom surface of the heating chamber;

an opening part for taking in and out the food of the heating chamber;

a temperature detector provided in an upper part of a substantially central part in horizontal direction of an inner wall surface of the heating chamber, said inner wall surface is opposed to the opening part; and wherein the temperature detector detects an infrared radiation is detected through an opening of the temperature detector so as to detect a temperature of the food, wherein the bottom surface of the heating chamber has a rectangular form and the breadth of the heating chamber is longer than length and wherein the opening part is positioned along the breadth;

wherein the temperature detector is designed to scan infrared ray detecting elements arranged linearly by a driving mechanism; and wherein the infrared ray detecting elements arranged linearly are mounted on a board and the board has a length perpendicular to the linearly arranged direction shorter than the length of the linearly arranged direction of the infrared ray detecting elements.

* * * * *